US011761650B2

(12) United States Patent
Haubrich

(10) Patent No.: US 11,761,650 B2
(45) Date of Patent: Sep. 19, 2023

(54) ATTIC VENTILATION SYSTEM

(71) Applicant: Keith Haubrich, Jacksonville, FL (US)

(72) Inventor: Keith Haubrich, Jacksonville, FL (US)

( * ) Notice: Subject to any disclaimer, the term of this patent is extended or adjusted under 35 U.S.C. 154(b) by 86 days.

(21) Appl. No.: 17/189,256

(22) Filed: Mar. 1, 2021

(65) Prior Publication Data

US 2021/0270475 A1 Sep. 2, 2021

Related U.S. Application Data

(60) Provisional application No. 62/983,574, filed on Feb. 28, 2020.

(51) Int. Cl.

| | |
|---|---|
| ***F24F 7/02*** | (2006.01) |
| ***F24F 11/00*** | (2018.01) |
| ***F24F 13/32*** | (2006.01) |
| ***F24F 11/88*** | (2018.01) |
| *F24F 13/20* | (2006.01) |
| *F24F 7/00* | (2021.01) |

(52) U.S. Cl.

CPC ..... *F24F 7/025* (2013.01); *F24F 11/0001* (2013.01); *F24F 11/88* (2018.01); *F24F 13/32* (2013.01); *F24F 2007/001* (2013.01); *F24F 2013/205* (2013.01)

(58) Field of Classification Search

CPC ..... F24F 7/025; F24F 11/0001; F24F 11/88; F24F 13/32; F24F 2007/001; F24F 2013/205

USPC ..... 454/260, 341, 366

See application file for complete search history.

(56) References Cited

U.S. PATENT DOCUMENTS

| | | | | |
|---|---|---|---|---|
| 3,125,284 | A * | 3/1964 | Lawler | F04D 25/02 29/521 |
| 9,303,887 | B1 * | 4/2016 | Chwala | F24F 13/32 |
| 2012/0014813 | A1 * | 1/2012 | Foreman | F24F 7/025 29/889.4 |
| 2012/0045983 | A1 * | 2/2012 | Eskola, III | F24F 7/025 454/341 |

OTHER PUBLICATIONS

Bill in Fairhope, "Attic fan replacement—no roof work!", May 10, 2019, https://www.youtube.com/watch?v=sOhd-0Y8RQQ (Year: 2019).*

* cited by examiner

*Primary Examiner* — Avinash A Savani
*Assistant Examiner* — Dana K Tighe
(74) *Attorney, Agent, or Firm* — Diana Mederos; Mederos Legal, PLLC

(57) ABSTRACT

An attic ventilation system that works universally with existing attic vents. The ventilation apparatus is mounted to the surface of an existing roof vent. The ventilation apparatus is connected to a power source such as a solar panel. The system and apparatus comprise a shroud comprised of a single piece.

6 Claims, 8 Drawing Sheets

ATTIC VENTILATION SYSTEM

CROSS REFERENCE TO RELATED APPLICATION

This application claims priority to U.S. Provisional Application No. 62/983,574, having a filing date of Feb. 28, 2020, entitled Attic Ventilation Fan. The entire contents therein are incorporated by reference.

FIELD OF THE DISCLOSURE

The present disclosure relates to an attic ventilation system. More specifically, the attic ventilation system works universally with existing roof ventilation openings. The attic ventilation system is fastened to existing trusses and is connected to a power source such as a solar panel and a motor to drive a fan.

BACKGROUND OF THE DISCLOSURE

Homes and buildings typically have attics that are often used for storage. However, attics typically do not have air conditioning like the remainder of the house or building. Instead, attics usually have ventilation openings such as roof vents, especially in warmer climates.

Proper attic ventilation not only helps with cooling and air circulation within the attic but also helps with keeping the rest of the building or home cool. Proper ventilation will also help prevent mold growth and condensation during cooler months.

Some common types of roof vents are gable vents, ridge vents with soffit and baffles, and static vents. Gable vents, as the name suggests, are located at a gable but provide ventilation in a limited area in and near the gable. Ridge vents are widely used and passively provide ventilation where the soffit allows air to enter the attic due to wind force. In the attic, the air is moved by convection, and the hot air exits through the ridge vent. Static roof vents are durable, long-lasting, and provide passive ventilation, but the passive ventilation may not be enough for houses and buildings in hotter climates. Some homes and buildings have small turbine vents; however, these are often unsightly and do not blend in with the architecture.

Adding additional vents or adding deflectors by cutting into the roof will not likely improve ventilation. In fact, it may do more harm than good because it increases the chances of having a roof leak. Other systems require mounting plates, central control connections with sensors and complex electronic components. Mounting plates add additional weight and make parts repair and replacement more difficult. Some attic soffits and insulation may need to be modified.

Some attic fans can be purchased by consumers for installation on the roof exterior surface. Some systems require additional ducts, baffles, conduits, and soffits. These attic fans are large, difficult to install, and are more suited for professional installation.

SUMMARY OF THE DISCLOSURE

What is needed is the attic ventilation system that can be retrofitted to existing attic vents and that is easy to install, easy to operate, and easy to maintain. The attic ventilation system does not require a plurality of vents, deflectors, a central controller, or a mounting plate. The attic ventilation system removes hot air and excess humidity from an interior space such as an attic which in turn reduces the cooling load and costs for running a traditional central air conditioner.

One embodiment of the attic ventilation system comprises a fan assembly with blades and a rotor are connected to a motor connected to a power source. The power source can be an electrical outlet or a renewable energy source such as a wind turbine or a solar photovoltaic cell panel. The system comprises a shroud with a shroud overhand that is fastened to trusses. The shroud comprises at least two recesses to accommodate and mount a motor bracket. The fan assembly lies in the shroud aperture. The shroud aperture extends into interior space but lies substantially flush into the space between the roof and the hood.

BRIEF DESCRIPTION OF THE DRAWINGS

The accompanying drawings that are incorporated in and constitute a part of this specification illustrate several embodiments of the disclosure and together with the description serve to explain the principles of the disclosure.

NUMERALS OF THE FIGURES

Figure 1:
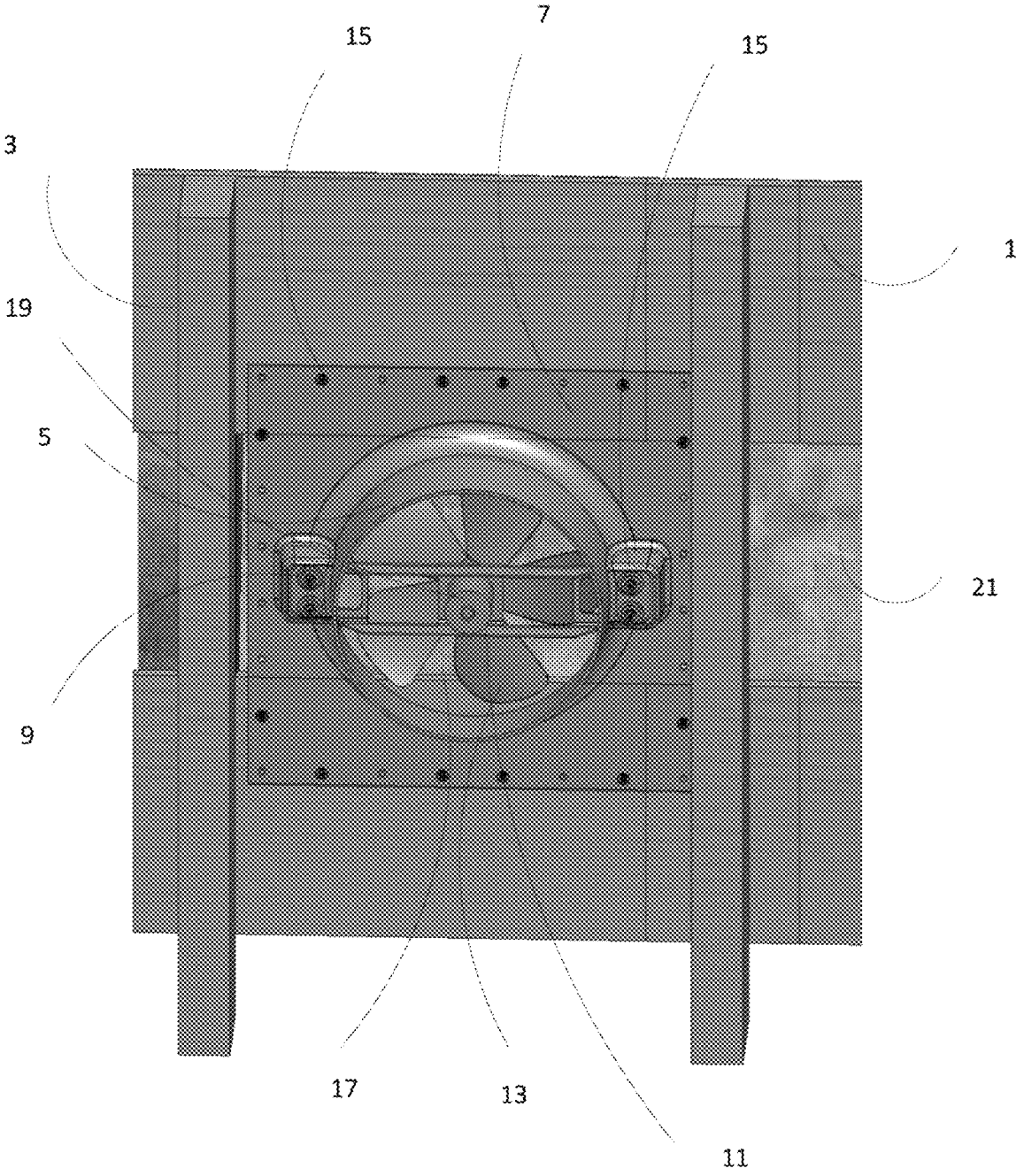
FIG. 1 shows a bottom interior view of an exemplary attic ventilation system.

1. roof
3. truss
5 shroud
7 shroud overhang
9. shroud recess
11. motor bracket
13. fan assembly
15. fastener
17. shroud aperture
19. motor
21. hood
23 interior
27 exterior
29 space
31 solar panel bracket
35 pv panel
37 gasket
39 adjustable mounting bracket
41 position brace
43 position aperture

DETAILED DESCRIPTION

The present disclosure provides generally for an attic ventilation system. According to the present disclosure, the attic ventilation system fits universally with existing roof vents or roof vent openings. The attic ventilation system actively increased air circulation to move hot air out of an attic. The attic ventilation system comprises a ventilation apparatus having fan coupled with electrical wiring, a funnel duct, brackets, and fasteners. The ventilation apparatus is connected via the electrical wiring to a power source such as a solar panel. The solar panel is preferably mounted onto the exterior surface of the roof and connected directly to the fan of the ventilation apparatus.

The attic ventilation system of the disclosure is designed for consumer installation. The attic ventilation system is presented as a kit that a consumer can purchase and install himself/herself. The attic ventilation system is fastened to trusses inside the attic. No additional modifications are necessary. Because the attic ventilation system is installed from the inside only, the exterior roof vents do not need to be removed or further modified with the exception of porting the electrical wiring from the power source to the fan. Installation from inside the attic eliminates the need for cutting additional openings into the roof or additional insulation or seals.

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

Referring now to FIG. 1, an exemplary attic ventilation system is shown viewed from the bottom and from inside an attic or other interior space. The exemplary system is shown with an attic ventilation apparatus having an electric motorized fan and a funnel duct or shroud mounted on trusses via a shroud overhang. The motor can have various voltages such as from 8 volts to 24 volts. The shroud overhangs are fastened to trusses inside the attic at an opening for an existing attic vent. The existing attic vent allows the escape of hot air. A power source such as a solar panel may be placed on the exterior of the roof and connected to a motor of a fan assembly with electrical wiring.

The funnel duct or shroud may have a wide end and a narrow end with the wide end facing against the attic vent opening in the attic ceiling and the narrow end facing the attic interior space. While this is a possible configuration, a preferred embodiment has the funnel duct or shroud with the narrow end against the attic vent opening and the wide end facing the attic interior space. The funnel duct or shroud of a preferred embodiment is essential for optimal air circulation and drawing the hot air from the attic interior and directing out to the roof vent. In some embodiments, the funnel duct or shroud may have an aperture of equal widths at the interior and at the exterior sides. The shroud is typically cylindrical and may lie flush with the truss facing the space between the truss and the roof hood and may extend into the interior attic space. The length or depth of the shroud can vary depending on the depth of the fan assembly.

The shroud with the aperture portion, overhang portions, and recesses are preferably molded as a single piece. The shroud overhangs extend a sufficient length to mount the shroud to the bottom of the trusses. Fasteners can be used to removably attach the shroud overhangs to the trusses. A motor bracket bisects the shroud aperture to support the fan assembly. The motor bracket is accommodated on either side of the shroud aperture in a shroud recess at either side of the shroud aperture.

If there is a fan already mounted, then it will need to be removed prior to installing the attic ventilation system. The attic ventilation apparatus including the fan, funnel duct or shroud, and brackets may be installed by placing the fan over the existing attic vent opening and fastening each bracket to a truss perpendicularly from the fan. The brackets may be fastened with fasteners such as screws, nails, or nuts and bolts. In some embodiments, stabilizers may be added to reduce vibration and fan noise. In some embodiments, mass may be added to the funnel duct to reduce vibration and noise.

Figure 2:
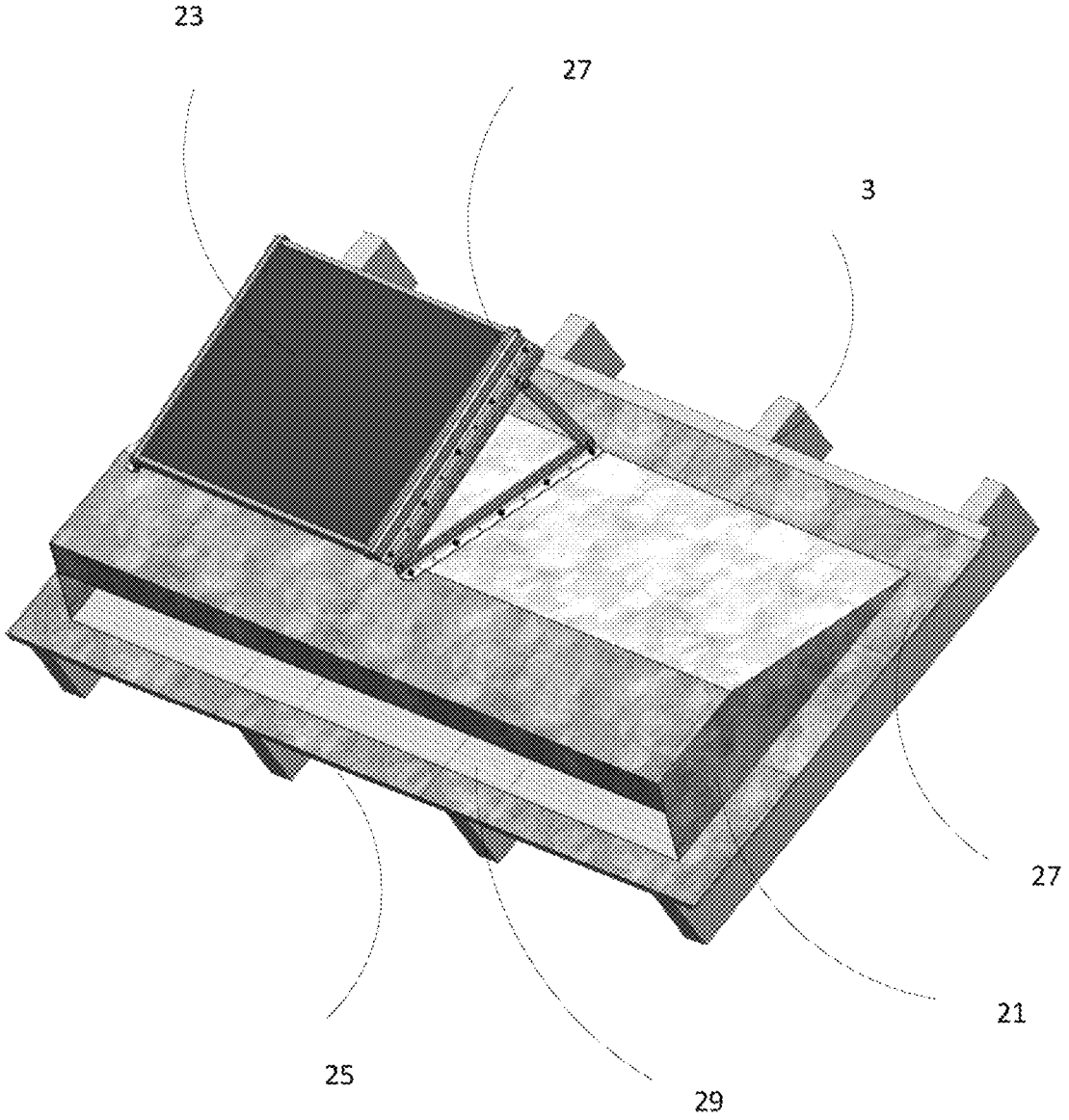
FIG. 2 shows a perspective view of a roof vent exterior with solar panel placement.

Referring now to FIG. 2, a roof vent exterior with solar panel placement is shown. The existing roof vent does not need to be removed, covered, replaced, or modified. The attic ventilation system works in connection with existing attic and roof vents, transforming the vent from passive ventilation to active ventilation. In some embodiments, the attic ventilation apparatus may be coupled with an autonomous power source such as a solar panel and may be sold together as an attic ventilation system kit. The solar panel, if a consumer does not already have one installed on the roof, is mounted on the roof exterior preferably near the roof vent. The solar panel is electrically connected to the fan via wiring that runs from the solar panel, through the vent opening, and to the fan.

Figure 3:
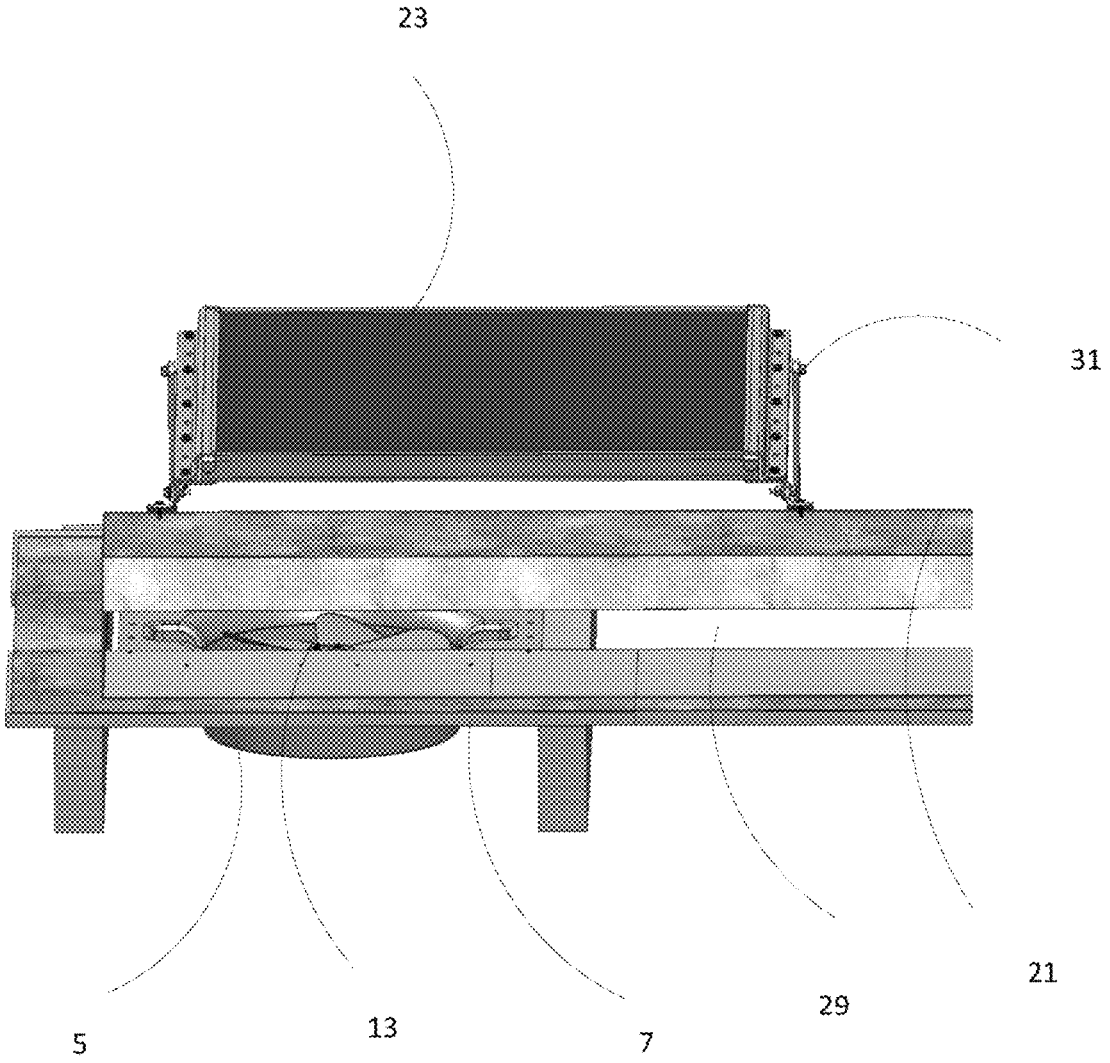
FIG. 3 shows a perspective view of an exemplary attic ventilation system.

Referring not to FIG. 3, an exemplary attic ventilation system is shown in a perspective view. The kit may include a solar panel or another autonomous power source. In some embodiments, the attic ventilation apparatus may be coupled with a decentralized control panel or personal computing device with a mobile application and having a processor and wireless communication transmitter and receiver. The control panel may be controlled via remote, a mobile application, or by voice command. A consumer may adjust the fan speed or may turn the fan on or off. The system may further be coupled with sensors for temperature and humidity for example. The system may have preset settings or may adjust the fan speed according to attic conditions as identified by the sensors.

The fan and funnel duct or shroud may have a variety of sizes and can be made out of any durable material such as steel, aluminum, or plastic polymers. The fan may vary in the number and shape of the blades. The brackets may be made in various sizes suitable for supporting the fan assembly. The motor bracket size may be adjustable and may be interchangeable to accommodate different length and width requirements for proper attachment to the shroud overhang recesses. The solar panel may be fastened to the roof via a bracket system.

Figure 4:
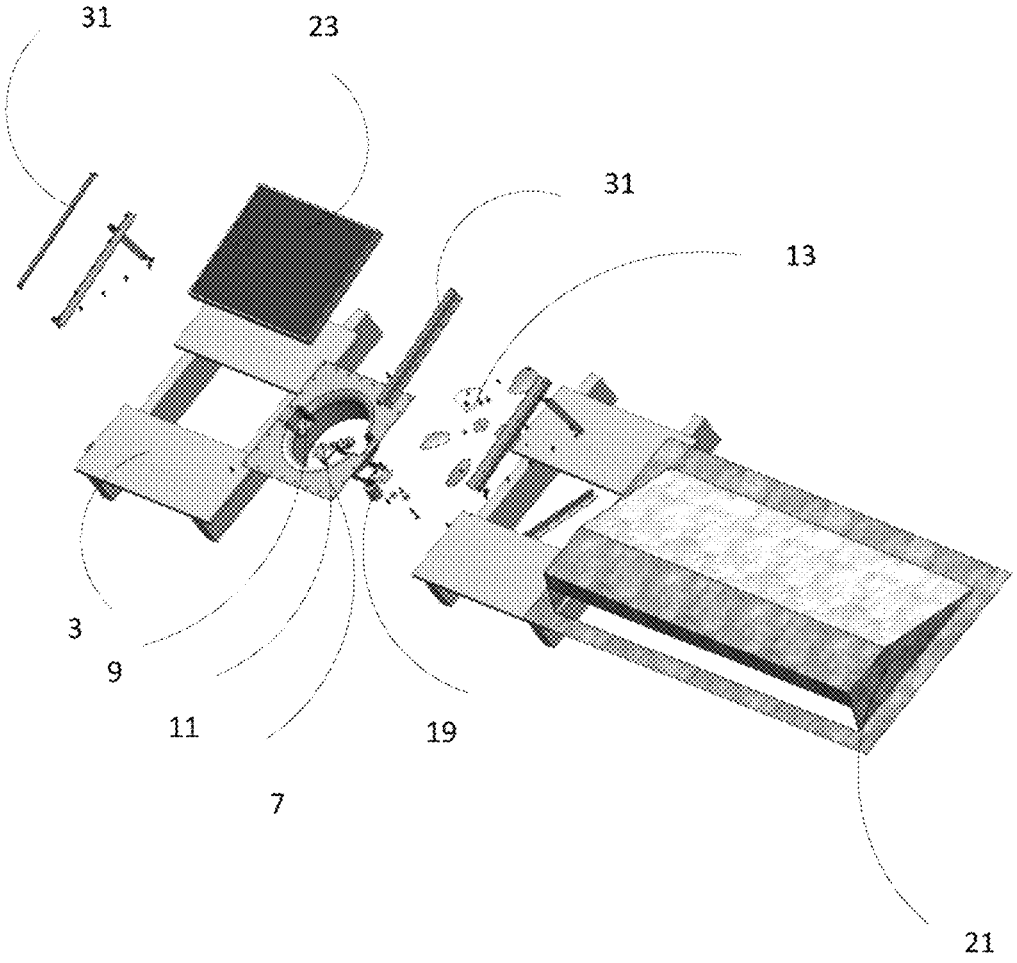
FIG. 4 shows multiple schematic views of an exemplary attic ventilation apparatus.

Referring now to FIG. 4, an exemplary attic ventilation apparatus is shown in an exploded view, the parts of which have been explained in the prior figures.

Figure 5:
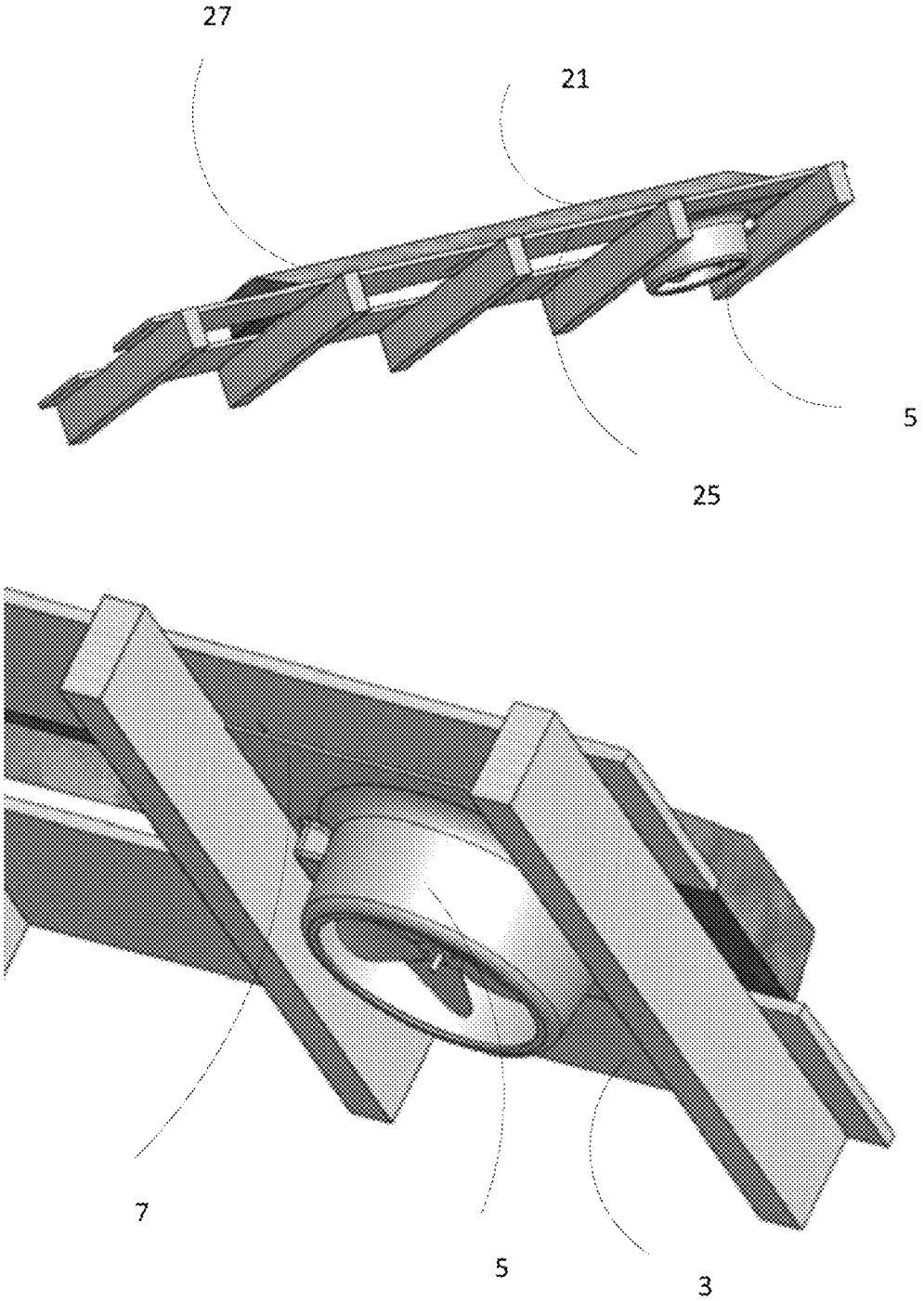
FIG. 5 shows perspective views of a mounted attic ventilation system, showing the interior and exterior.

Referring now to FIG. 5, perspective views of a mounted attic ventilation system, showing the interior and exterior are shown. An exemplary attic ventilation system has a fan with a motor and a vacuum shroud connected to a bracket which is fastened to the roof vent opening and in between the roof trusses. The fan draws the hot air from the attic and pushes the air through the roof vent and outside.

Figure 6:
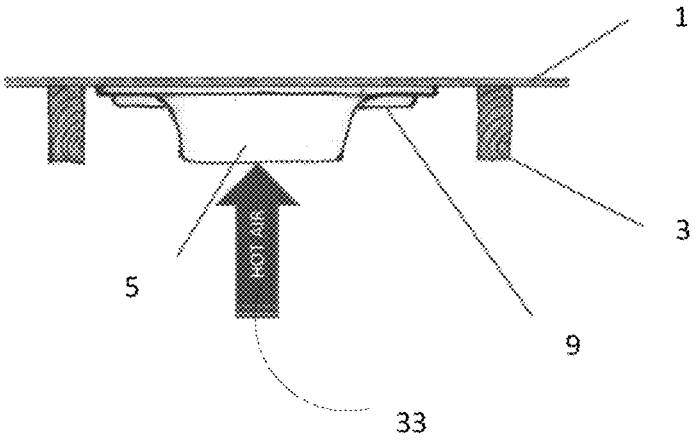
FIG. 6 shows the general concept of an exemplary attic ventilation system and an exemplary motor configuration.

Referring now to FIG. 6, the general concept of an exemplary attic ventilation system and an exemplary motor configuration are shown. In preferred embodiments, but not exclusively, an attic fan has a deep circular or shallow cylindrical structure forming a vacuum shroud. The fan is attached to the interior surface of the roof and in between roof trusses. The fan is mounted on a motor bracket with depths depending on the motor type. Brackets can have various fixed or adjustable configurations to accommodate the shape and size of fan motor. The fan motor can be mounter either on top of the motor bracket or to the bottom of the motor bracket.

Figure 7:
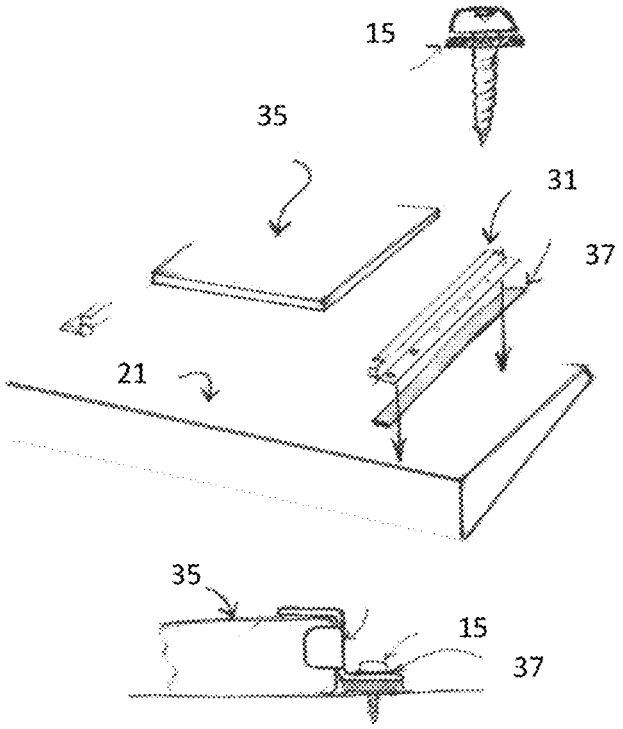
FIG. 7 shows an exemplary attic ventilation system with an optional solar panel mount.

Referring now to FIG. 7, an exemplary attic ventilation system with an optional solar panel mount is shown. A solar panel, also referred to as a PV panel can be attached directly onto a hood on the exterior of the roof. A pv bracket will secure a pv panel to the hood at a pv panel and hood side edge. A fastener clamps the pv bracket onto the roof surface, securing the pv panel on top of the hood. The pv panel can be connected electrically to the fan apparatus to provide power.

Figure 8:
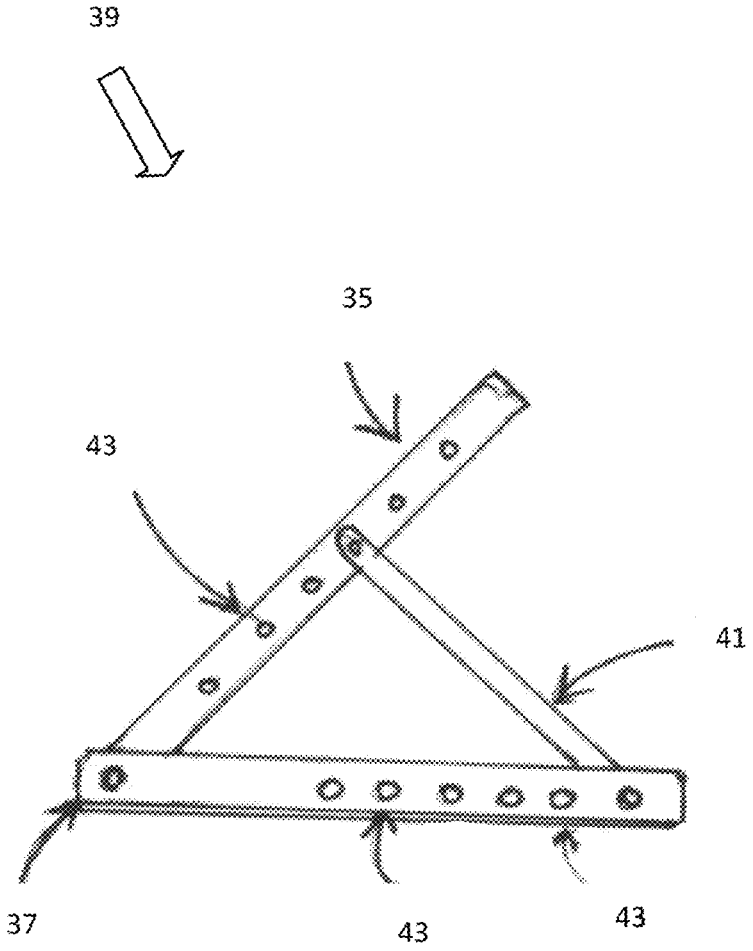
FIG. 8 shows an exemplary attic ventilation system adjustable mounting bracket.

Referring now to FIG. 8, an exemplary attic ventilation system adjustable mounting bracket. The adjustable mounting bracket is useful for when there are structural constraints, obstacles, and to accommodate fans of a variety of strengths and sizes. A PV panel comprises positions. A vent mounted bracket comprises positions. The PV panel and the vent mounted bracket are joined at an apex by a gasket. The inner angle between the PV panel and the vent mounted bracket may be adjusted by swiveling the position brace between the PV panel and the bracket at varying positions via the position braces and the position apertures. The position brace will connect the PV panel and the bracket, stabilizing the overall mount.

CONCLUSION

A number of embodiments of the present disclosure have been described. While this specification contains many specific implementation details, these should not be construed as limitations on the scope of any disclosures or of what may be claimed but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination.

Thus, particular embodiments of the subject matter have been described. Other embodiments are within the scope of the following claims. In some cases, the actions recited in the claims can be performed in a different order and still achieve desirable results. Various modifications may be made without departing from the spirit and scope of the claimed disclosure.

What is claimed is:

1. An attic ventilation system, the system comprising a power source, a fan assembly, and a cylindrical shroud comprising an aperture, overhangs, and recesses in a single piece;

wherein the shroud aperture has a wide end and a narrow end;

wherein the shroud overhangs are fastened to trusses inside an attic and at an existing roof vent opening without removing an existing roof hood;

wherein a motor bracket bisects the shroud aperture to support the fan assembly; and wherein the shroud is connected to a bracket that is fastened to the roof vent opening and between the trusses.

2. The system of claim 1, wherein the power source is a solar panel mounted to a vent-mounted adjustable bracket by a swivel position brace.

3. The system of claim 2, further comprising a plurality of fasteners connecting the solar panel and the vent-mounted bracket at an apex.

4. The system of claim 1 wherein the shroud aperture wide end faces an attic interior space, and the narrow end faces an attic vent opening.

5. The system of claim 1 wherein the shroud aperture wide end faces an attic vent opening, and the narrow end faces an attic interior space.

6. The system of claim 1 wherein shroud is positioned between the trusses and extends into an attic interior space.

* * * * *